United States Patent [19]

Aubert et al.

[11] Patent Number: 4,726,916

[45] Date of Patent: Feb. 23, 1988

[54] METHOD FOR EMBEDDING AND STORING DANGEROUS MATERIALS, SUCH AS RADIOACTIVE MATERIALS IN A MONOLITHIC CONTAINER

[75] Inventors: Bruno Aubert, Elancourt; Serge Carpentier, Villecresnes, both of France

[73] Assignee: Societe Generale pour les Techniques Nouvelles S.G.N., Saint Quentin En Yvelines, France

[21] Appl. No.: 728,812

[22] Filed: Apr. 30, 1985

[30] Foreign Application Priority Data

May 4, 1984 [FR] France ..... 84 06969

[51] Int. Cl.[4] ..... G21F 9/16; B30B 7/04

[52] U.S. Cl. ..... 252/629; 100/236; 100/237; 100/244; 250/506.1; 252/628; 252/633

[58] Field of Search ..... 250/506.1, 507.1; 252/633, 628, 629; 264/0.5; 100/269 R, 244, 237, 236; 501/155, 152, 153

[56] References Cited

U.S. PATENT DOCUMENTS

| | | | |
|---|---|---|---|
| 3,170,578 | 2/1965 | Moreland | 100/244 |
| 3,249,551 | 5/1966 | Bixby | 252/629 |
| 3,358,590 | 12/1967 | Howard | 100/218 |
| 4,172,807 | 10/1979 | Larker | 252/628 |
| 4,224,177 | 9/1980 | Macedo et al. | 252/629 |
| 4,297,304 | 10/1981 | Scheffler et al. | 264/0.5 |
| 4,303,412 | 12/1981 | Baikoff | 100/295 |
| 4,312,774 | 1/1982 | Macedo et al. | 252/629 |
| 4,333,847 | 6/1982 | Tran et al. | 252/629 |
| 4,354,954 | 10/1982 | Koster et al. | 252/633 |
| 4,362,659 | 12/1982 | Macedo et al. | 252/629 |
| 4,534,893 | 8/1985 | Dippel et al. | 252/629 |

FOREIGN PATENT DOCUMENTS

| | | | |
|---|---|---|---|
| 0005700 | 1/1983 | Japan | 252/629 |

OTHER PUBLICATIONS

Ringwood, et al., 1979, The Qynroc Process: A Geochemical Approach to Nuclear Waste Immobilization, Geochemical Journal, vol. 13, pp. 141-165.

Search Report of Rapport De Recherche, dated Mar. 22, 1985, Australian Patent Abridgement No. 531,250.

*Primary Examiner*—Stephen J. Lechert, Jr.
*Assistant Examiner*—Howard J. Locker
*Attorney, Agent, or Firm*—Brumbaugh, Graves, Donohue & Raymond

[57] ABSTRACT

The present invention relates to a method for immobilizing and packing radioactive "ashes" in a mineral matrix, said method consisting in adjusting the coefficient of expansion of said ashes, molding around said ashes a porcelain in the raw state and taking the whole in one operation to form a hermetically sealed block.

7 Claims, 19 Drawing Figures

METHOD FOR EMBEDDING AND STORING DANGEROUS MATERIALS, SUCH AS RADIOACTIVE MATERIALS IN A MONOLITHIC CONTAINER

The present invention relates to a method for embedding with a view to storing, dangerous materials, such as radioactive materials, in a monolithic container. It further relates to a device for carrying out said method and to the product obtained with said method.

The activities of a nuclear center produce a special kind of wastes which cannot be treated with wastes from other industries because of risks of radioactive contamination.

This is the case for example with gloves, rags, clothing, filters, small equipment in plastic materials, etc . . . of fairly low radioactive contamination.

In order to limit the volume of the contaminated material to be stored, a simple solution has already been proposed which consists in burning the waste so as to eliminate all materials that are readily decomposable by heat. The radioactivity remains confined in the ashes or in the particles stopped by the filtration of the gases released from the incinerator.

Said ashes, are thereafter inserted into a matrix which can withstand leaching and crushing. For example, radioactive ashes are mixed with a polymerizable polyester resin and the mixture is stored in sealed metallic barrels.

One disadvantage of such methods is the fact that in several stages, are necessary to complete the operation, i.e. the ashes must be mixed with the embedding material, the mixture must be poured into metallic barrels, polymerized, and the barrels sealed.

Moreover, a further problem is the resistance, of the barrels over time to the material contained therein.

A further problem is the flammable nature of the matrix contained in the barrels.

It is also known to pack strongly radioactive waste, consisting of solutions of fission products, in the form of glass, cast in a metallic container.

Radioactive iodide I 129, in the form of lead iodine is another example of difficult storage. When irradiated combustible materials are dissolved in order to be reprocessed, amongst the gases released, is a certain quantity of iodide. This is the long-period isotope I 129 (about 17 millions of years). It is known to trap the iodine by converting it into lead iodide. This form is hardly soluble in water and is particularly advantageous for long-term storage.

The immobilization of solid materials in a mineral matrix resistant to leaching and necessitating no metallic containers, is an advantageous solution to the problems related to the treatment and storage of radioactive wastes.

Australian Pat. No. 531,250 describes a method of this type in which the wastes, in powder form, are mixed with a powdered synthetic rock and compressed, the resulting core being then surrounded with an expansion-absorbing covering of low-density material, which in turn is surrounded by a covering of clean synthetic rock; the resulting block is then subjected to the action of heat and pressure. To carry out such a method, it is necessary to have a special apparatus in the form of a die-block with graphite walls able to withstand high temperatures. Indeed, the formation of the rock structure to arrive at a compact block from powders of the materials composing said rock, is not in the least easy. The effects of heat and pressure have to be conjugated and their values must be high enough. In addition, the starting materials being in powder form, air is contained in the powder so that in the final baking operation, the confined air and any gases which have formed in the wastes cannot really escape, this causing fissures, etc. To overcome the aforesaid disadvantages, the Applicant proposes a method of immobilizing and packing radioactive ashes in a mineral matrix, which method can be carried out with simple equipment, requiring no heating under pressure. The novel process, uses covering materials in paste or powder form with pressing in stages and final heating according to a specific program so that gases are released before the porosity closes up. The result is a monolithic block, i.e., a hermetically sealed block.

More specifically, the invention is characterized in that it comprises:

forming by molding, preferably with pressure, the bottom and side walls of a box, using a porcelain slip, depositing the ashes and a ceramic-forming composition, in the formed cavity, and subjecting the resulting mixture to pressure, placing over the surface thus obtained and over the upper surface of the side walls, a layer of porcelain slip, which is, preferably, thereafter pressed;

and subjecting the whole to a heating operation designed to bake said porcelain slip and said ceramic-forming composition, said heating being programmed so as to allow a release of any gases already present in the mixture, or which have formed therein.

The materials to be embedded are hereinafter referred to as "ashes"; indeed, they are often constituted by the ashes resulting from the combustion of dangerous and/or radioactive materials; but said materials could also be the calcinate of solutions of fission products or lead iodide.

The term porcelain slip means, in general, a ceramic, containing preferably between 4 and 7% water, and being at the start in the form of a pulverized paste, molded in the raw state and then baked.

Suitable porcelains include sandstone, earthenware, hard or mullite porcelain. They are generally composed of a mixture of feldspar, clay, sand, kaolin and in some cases, enriched alumina.

The adjustment of the ashes expansion coefficient is generally and preferably achieved by mixing said ashes with a ceramic-forming composition, namely an addition substance which, after baking in the same baking conditions as the porcelain, will give a ceramic or a glass. The baked piece will be called a crock. Said ceramic-forming composition is composed of silicates or alumino-silicates of alkaline metals, alkaline-earth metals or magnesium.

According to another embodiment of the invention, the ashes are placed inside a plastic bag, which is in turn placed in the cavity of the box, then said box is filled with the porcelain slip, and pressure is applied. Under the effect of the pressure applied by the plunger, the bag bursts and the air contained therein is released. In this case, the ceramic-forming composition is the porcelain slip itself.

The fourth wall of the container which enables it to be hermetically-sealed is prepared by depositing a layer of porcelain slip over the entire upper surface of the container, which layer can then be optionally pressed.

The last operation is a baking operation, in an oven for example, the heating program being so determined that any gases, present or in formation, can escape through the walls of the container before the pores close up.

A cylindrically shaped hermetically-sealed block is thus obtained, said block comprising a core portion containing radioactive ashes possibly dispersed in a ceramic composition, and a homogeneous external crust, preferably having a uniform thickness, and consisting of baked porcelain.

The preferred device for carrying out the pressing operation comprises a cylindrical die, an annular plunger sliding in said die and a solid plunger sliding in said annular plunger.

Said device and its uses in carrying out the method according to the invention are described in accompanying FIGS. 1 to 19.

The invention will be more readily understood on reading the following description with reference to the accompanying drawings, in which.

Figure 1:
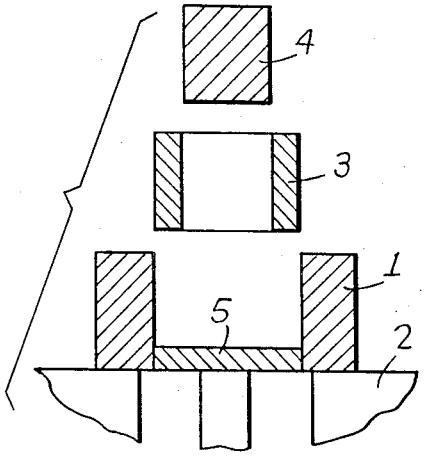
FIG. 1 is a diagrammatical illustration of the pressing device.

The implementation of the method according to the invention with the device illustrated in FIGS. 1 to 19, will now be described.

A matrix 1 is placed on the lower plate 2 of a die.

An annular plunger 3 slides with small clearance into said matrix.

A solid plunger 4 slides will small clearance in the inner part of the annular plunger 3.

A piston 5, traversing plate 2, facilitates removal of the block from the mold.

A device, not shown, and joined to the upper plate of the die, enables to optionally raise or lower the plungers 3 and 4, either together or separately. The force of the die enables to obtain an inside pressure of 3.5 GePa.

Figure 2:
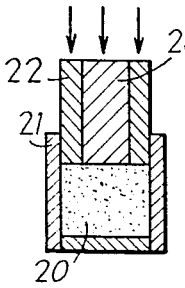
FIGS. 2 to 11 show the plungers moving cycle.

FIG. 2 diagrammatically shows the first phase; the die 21 contains the raw paste 20 which will form the bottom of the container. The annular plunger 22 and central plunger 23 are descending simultaneously under the action of the die.

Figure 3:
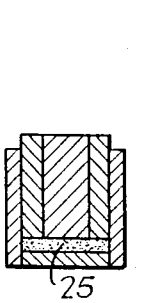

FIG. 3 shows the end of the first phase where the bottom of the container can be seen in 25, such as produced in raw paste.

Figure 4:
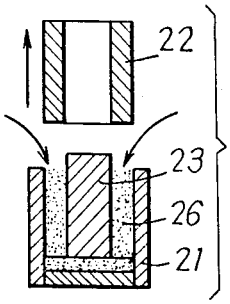

FIG. 4 shows the beginning of the pressing phase of the side wall of the container: annular plunger 22 is in the raised position and the raw paste 26 fills the space between the plunger 23 and the die 21.

Figure 5:
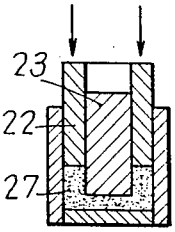

In FIG. 5, the plunger 22 is pressed in so as to form, by pressing, the side wall (in the raw state) 27 of the container.

Figure 6:
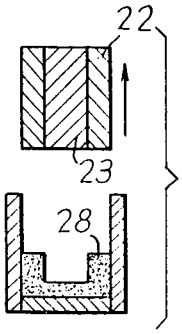

In FIG. 6, the two plungers 22 and 23 are raised up, and it can be seen that a box 28 has been formed in the die 21.

Figure 7:
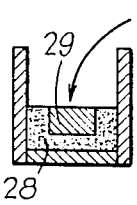

In FIG. 7, said box 28 is filled with the product 29. Said product can be enclosed in a thin plastic bag to prevent any contamination of the plungers.

Figure 8:
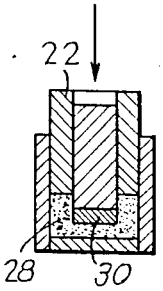

In FIG. 8, the plunger 22 is brought into contact with the upper part of the box, then it is lowered for compressing the matrix to be embedded, which then takes the shape shown in 30.

Figure 9:
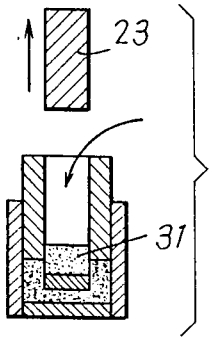

FIG. 9 illustrates the following phase in which the plunger 23 is in raised position, whereas the plunger 22 has not moved and the raw paste designed to form the upper face (or cover) is introduced in 31.

Figure 10:
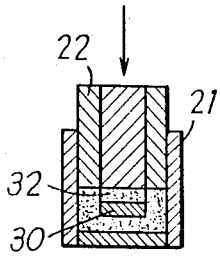

FIG. 10 shows the phase in which the cover is compressed, to take the form 32 obtained by stopping the plunger 23 just on the same low level as plunger 22.

Figure 11:
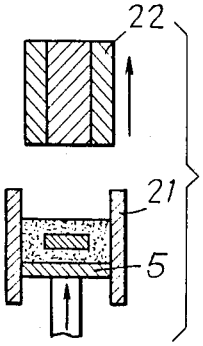

The pressing operations are completed and FIG. 11 shows the removal from the mold.

It will be noted from FIGS. 6 and 7 that it is possible as a variant, to leave the plunger 22 in the low position.

It is likewise possible, according to FIGS. 9 and 10, to proceed slightly differently, and to bring up the two plungers to make a cover which reaches to the edges of the die.

The raw piece, which has been removed from the mold, is baked in an electric oven, according to a specific heating program. Said heating program will be detailed in the examples given hereinafter.

It is important to regulate the program so that any gases which have formed or which were already inside (mainly air, water and carbon dioxide) can escape through the walls before the pores close up.

Different tests conducted have revealed that removal of the gases was perfect for materials presenting a loss on ignition of 15% with the proposed program. For a greater loss on ignition, the rise in temperature will have to be curbed, which is a well known technique.

For certain radioactive materials, a problem is encountered due to an incompatibility of the coefficients of expansion between the radioactive material, and the porcelain.

In the case, a ceramic-forming or vitrifying agent or composition is used (both terms being acceptable).

The ashes to be embedded are mixed with said ceramic-forming agent in a proportion such that the new material has, after baking, an expansion coefficient approaching $4.10^{-6}/°C.$ as most porcelains.

The best results are obtained with substances with a low (if not negative) coefficient of expansion, such as alumino-silicates of lithium (beta-spodumen, eucriptite and petalite) or alumino-silicates of magnesium (cordierite) and more generally, alkaline alumino-silicates and alkaline-earth silicates.

In the case of ashes from an incinerator, as illustrated in Examples 1 and 2 hereafter, no ceramic-forming agent is required.

The same applies to Example 6 where the embedding substance is lead iodide.

In the case of silicium carbide illustrated in Example 3, a ceramic-forming agent is added.

In the case where asbestos fibers are embedded, it has been preferred, in order to facilitate handling operations, to prepare a paste with the asbestos and the embedding porcelain.

In the case of fission products, a calcinate of a solution of fission products is embedded after the addition of a ceramic-forming agent.

The following examples are given to illustrate non-restrictedly the invention.

The first two examples are concerned with the embedding of the same ashes in two different matrices (and at two different scales).

The third example is concerned with the embedding of silicium carbide particles coming from the combustion chamber of a waste incinerator.

The fourth example is concerned with the embedding of asbestors fibers which have been used as a filtering medium for hot gases.

The fifth example is concerned with the embedding of a calcinate of fission products (obtained by evaporation and calcination at 600° C. of a solution of fission products).

The sixth example is concerned with the embedding of lead iodide.

EXAMPLE 1

Composition of the ashes to be embedded:
$SiO_2$: 17.29% by weight (after drying)
$AL_2O_3$: 21.71
$Na_2O$: 1.08
$K_2O$: 1.30
CaO: 12.81
$Fe_2O_3$: 10.63
$P_2O_5$: 5.75
$Sb_2O_3$: 0.67
CdO: 0.05
MnO: 0.12
ZnO: 11.43
$Cr_2O_3$: 0.70
MgO: 2.08
$SnO_2$: 0.75
PbO: 3.69
CuO: 3.90
BaO: 0.83
$TiO_2$: 4.98

The complement to 100% is principally composed by traces of carbonates.

The die has an internal diameter of 70 mm ($70_{+0.2}{}^{+0}$).

The annular plunger has an external diameter of 70 mm ($70_{-0.2}{}^{-0}$) and internal diameter of 50 mm ($50_{+0.2}{}^{+0}$).

The solid central plunger has a diameter of 50 mm ($50_{-0.2}{}^{-0}$).

A sandstone-type ceramic slip is used, said slip being obtained by mixing with wet-crushing in an earthenware jar:
White-baking clay: 45%
kaolin: 15%
Quartz (sand): 20%
Feldspar: 20%
this corresponding to the chemical composition (excluding the water)=$SiO_2$: 71%, $Al_2O_3$: 23%, $Na_2O+K_2O$: 6%, plus traces of iron, titanium, magnesium, calcium and other oxides.

The porcelain slip is pulverized in order to obtain a powder of fairly close granulometry:
1.35% greater than 0.510 mm
14.30% between 0.510 and 0.280 mm
71.80% between 0.280 and 0.104 mm
8.00% between 0.104 and 0.053 mm
4.00% less than 0.053 mm
with a residual humidity varying between 4 and 7%.

90 g of said powder are placed in the matrix and pressed progressively with two plungers, according to the preset program:
rising to 50 bars—plateau 20 seconds
descending to atmospheric pressure
rising to 150 bars—plateau 40 seconds
descending to atmospheric pressure
rising to 350 bars—plateau 60 seconds
descending to atmospheric pressure and rise of annular plunger.

The bottom of the container has also been formed with a powder containing little air thanks to the pressure program.

Some powder is placed in the annular space and it is compressed according to the preceding program in order to end at a height of 47.3 mm from the bottom of the matrix.

Both plungers are removed and a "box" is obtained, the cavity of which is filled with a mixture of ashes+10% of beta-spodumen (alumino-silicate of lithium) which is compressed with the central plunger so as to come flush with the upper level of the "box".

Said central plunger is raised up, and 90 g of powder are placed on the annular wall of the box and on the compressed ashes, then the two plungers are pressed down on the powder (according to the preset pressure program) to form an 11 mm thick cover.

The resulting volume is removed from the mold and baked in an electric oven according to the following baking program:
from 25° to 150° in 600 minutes (linear rise)
from 150° to 400° in 600 minutes (linear rise)
from 400° to 600° in 600 minutes (linear rise)
from 600° to 800° in 600 minutes (linear rise)
from 800° to 1000° in 1200 minutes (linear rise)
from 1000° to 1090° in 900 minutes (linear rise)
from 1090° to 1130° in 800 minutes (linear rise)
from 1130° to 1150° in 800 minutes (linear rise)
Plateau for 240 minutes at 1150° then down
from 1150° to 600° in 450 minutes
from 600° to 500° in 200 minutes
from 500° to 25° in 475 minutes A cylinder of yellowish white color is brought out of the oven, the diameter of which is 63 mm and the height 58 mm.

No fissure, and no deformation can be seen on the crock.

Figure 12:
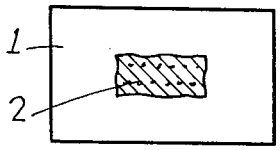
FIG. 12 shows a cross-section through the diameter of a crock.

When sawing with a diamond saw, the section is as illustrated in FIG. 12.

Zone 1 is a hard, compact ceramic with no porosity. Zone 2 is a cluster of more or less vitrified ashes. The change-over between these two zones takes less than 0.1 mm.

EXAMPLE 2

Ashes of the same composition as those of Example 1 are used for embedding in a mullitic porcelain (also called hard porcelain). The starting paste is approximately composed of:
$SiO_2$: 58
$Al_2O_3$: 24
$Na_2O$: 1
$K_2O$: 3
CaO: 1
MgO: 0.1
Water in sufficient quantity for 100% (about 13%).

It will be noted that the water contains about 70% of constitution water (in particular in the kaolin used for preparing the paste) and 30% of preparation water.

To simplify, it is also possible to use a product manufactured under reference 42 555 by the "Kaolins et Pâtes céramiques du Limousin".

The same equipment as described hereinabove but of larger dimensions is used for the pressing operation; external diameter of the annular plunger 160 mm and internal diameter of the annular plunger 113 mm.

The pressing force being around 700 kN.

The pressing operations take place as in Example 1 for the decompression cycles.

The baking is conducted according to the following cycle:

rising from 25° to 800° C. in 31 hours
rising from 800° to 1080° C. in 28 hours
rising from 1080° to 1120° C. in 7 hours
rising from 1120° to 1200° C. in 27 hours
going down from 1200° to 600° C. in 7.5 hours
going down from 600° to 500° C. in 3.5 hours
going down from 500° to 25° C. in 8 hours After the baking operation, a block of cylindrical monolithic appearance is taken out of the oven, weighing 6.5 kg.

No porosity is visible and no fissures occur. A sawing operation reveals that the ashes form an homogenous mass of about 100 mm diameter, surrounded in all directions by a thickness of about 21 mm of very hard porcelain.

There is no trace of any dispersion of the ashes in the porcelain.

EXAMPLE 3

Embedding of silicium carbide particles

The particles to be embedded have a diameter of between 1 and 15 mm and result from the rough crushing of silicium carbide aggregates taken from the post-combustion chamber of an incinerator.

A frit of composition $SiO_2$: 74.9%, $Al_2O_3$: 13.50%, CaO: 7.7%, MgO: 2.1%, $K_2O$: 0.75%, $Na_2O$: 1.05% is mixed with the silicium carbide particles (20 g of said composition for 100 of SiC). The coefficient of expansion of said frit being near to that of the silicium carbide.

Exactly the same conditions are followed as in Example 1 for the molding and baking operations and the result is a solid cylinder.

Sawing with a diamond saw (an operation which is rather difficult because of the large particles of SiC) reveals that the SiC is completely embedded in the composition which has melted.

This heterogeneous mass is perfectly surrounded by the clay and no fissures are visible.

EXAMPLE 4

Embedding of asbestos fibers

The asbestos is taken from the hot gases filter of an incinerator. A paste is prepared with equal volumes as asbestos and of the clay slip from Example 1, and the resulting mixture is then treated like the ashes were in Example 1. After molding and baking, a faultless cylinder is obtained. Sawing reveals on the inside a greener zone which corresponds to the clay-asbestos mixture virtually without any transition, the pure clay surrounding the central zone.

EXAMPLE 5

Embedding of fission products

When re-processing nuclear combustible substances, the fission products are separated from the uranium and plutonium in the form of a nitric solution.

To immobilize these substances as waste materials, the method normally used consists in concentrating them be evaporation, calcinating them, mixing them with a glass frit, melting the mixture and casting it in tight containers.

To show that the present invention is also suitable for embedding the fission products, we have simulated a calcinate using non-radioactive products.

The composition of the synthetic calcinate is: (% by weight)

| | |
|---|---|
| Strontium oxide | 2.71 |
| Yttrium oxide | 1.77 |
| Zirconium oxide | 15.17 |
| Molybdenum oxide | 15.81 |
| Manganese oxide | 9.04 |
| Cobalt oxide | 2.19 |
| Nickel oxide | 4.84 |
| Cesium oxide | 9.52 |
| Baryum oxide | 6.00 |
| Cerium oxide | 8.68 |
| Lanthanum oxide | 24.27 |

For the embedding, said calcinates are mixed with 10% by weight of petalite and 10% by weight of sodium silicate, and the procedure is the same as in Example 1.

After cooling, the container is sawed and it is found that the calcinate has transformed into a vitreous mass filling to more than 90% (several bubbles remaining) the central area of the crock.

There is no trace of diffusion in the walls of the container.

EXAMPLE 6

Embedding of lead iodide 69 g of ashes from Example 1
30 g of lead iodide ($PbI_2$)
0.65 g of cesium carbonate
are dry-mixed.

The resulting powder is used in the conditions of Example 1 to be embedded in clay.

After baking and cooling, a faultless cylindrical block is brouth out of the oven, with no visible porosity.

Figure 13:
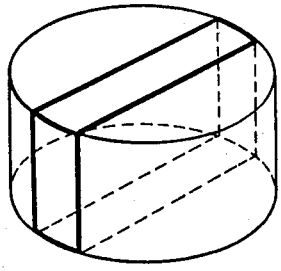
FIGS. 13 and 14 show the pieces to be cut for analyzing purposes.
Figure 14:
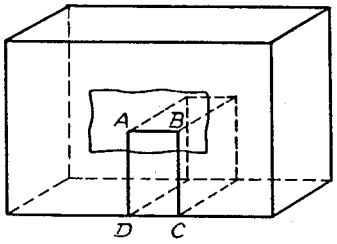

To determine the reliability of the packing thus used, said block is cut through as illustrated in in FIGS. 13 and 14.

Then, the face ABCD is polished, gold-plated and a series of measurements are taken with the microprobe, adjusting the detection on one element.

Figure 15:
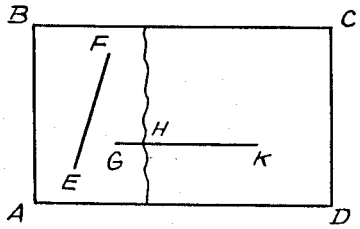
FIG. 15 shows the analyzed points.

First, a series of measurment are taken along the path EF of FIG. 15, in the core, namely in the part composed before the baking of ashes, lead iodide, cobalt and cesium.

Figure 16:
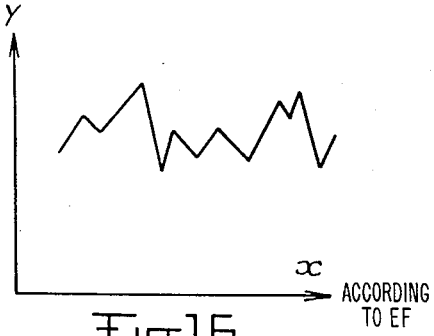
FIGS. 16 to 19 show recordings of the measurements taken with an electron probe.
Figure 17:
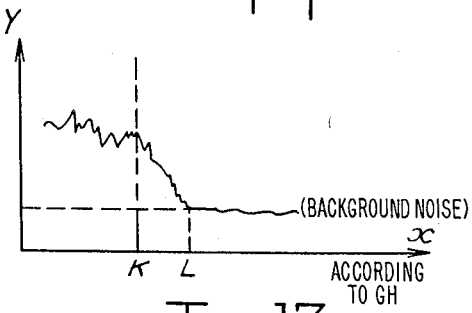

FIG. 16 gives the number of strokes counted in y-axes and the displacement along EF in x-axes.

It is found that the curves show a very variable level, this being explained by the porosity of the core: there are many bubbles on path EF. To each bubble corresponds a reduction of the quantity of excited material, hence of the overall number of counted strokes.

FIG. 16 gives in y-axes the number of strokes counted for iodine (rai L alpha L beta) and in x-axes, the movement along H, point K corresponding to the boundary between the core and the embedding and distance K L corresponding to 1 mm.

It is found that the number of strokes, namely a value proportional to the concentration, is in average constant (to the nearest fluctuations of porosity) inside the core, and decreases from K to L over a 1 mm distance, to reach background noise.

Said background noise which corresponds to a detection threshold can in effect be taken as zero for the iodine concentration. Indeed, the same value of background noise is obtained on a ceramic such as used in Example 1 which contains no iodine.

The interpretation of said curve is that the iodine present in the core has slightly migrated outwardly but that the migration has concerned only an area of 1 mm thickness around the core.

This enables to confirm that the type of embedding described in the present invention constitutes a very efficient barrier against the escape of iodine, and this, even at high temperature since, in the present example, the temperature was adjusted to 1150° for 4 hours for baking the piece.

The cesium and cobalt contents were analyzed on the same sample piece and still along path GH.

Figure 18:
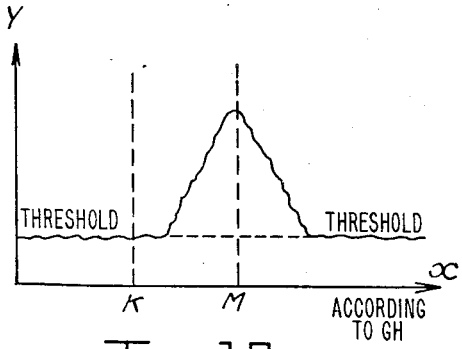

FIG. 18 gives the recordings for cobalt in the core, where the threshold of response is reached, up to point K and beyond in the embedding clay, since the x-axis of the peak corresponds to KM=2 mm and the width of the peak is 1 m.

It can be said that the cobalt has moved from the core towards the outside but that the baking of the crock, in closing up all the pores, has stopped the migration.

Figure 19:
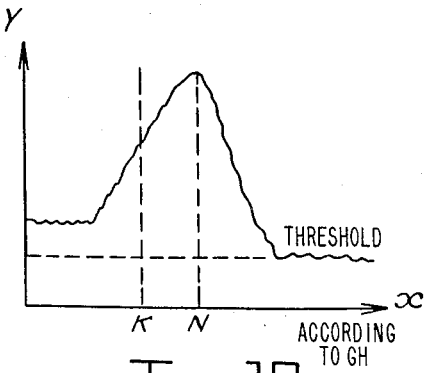

FIG. 19 shows, in the case of the cesium, that the migration has been only partial since the core contains a considerable part of the cesium.

Other tests which need not be detailed, have shown that it is possible to embed a mixture of ashes and lead iodide, in equal weights (50% $PbI_2$ and 50% ashes).

If there are no ashes, it is possible to mix the lead iodide with a paste or raw clay and to embed the mixture as described hereinabove.

The present invention shows great advantages for the permanent embedding of contaminated materials, within a material of illimited life duration, even in very adverse conditions, without a metallic or other type of casing having to be provided around the block produced according to the present method.

What we claim is:

1. A method of containing and immobilizing radioactive waste material comprising the steps of:

(a) forming by molding under pressure a containment vessel having a bottom and side walls, said containment vessel being formed from a porcelain slip;

(b) mixing the radioactive waste with a ceramic-forming composition in proportions such that the coefficient of expansion of said mixture is substantially equal to the coefficient of expansion of said porcelain containment vessel;

(c) depositing the radioactive waste/ceramic-forming composition mixture into said containment vessel;

(d) compacting said mixture under pressure;

(e) placing a cover over said containment vessel, said cover comprising a layer of the porcelain slip; and (f) heating the covered vessel at atmospheric pressure so as to allow any gases formed during heating to escape from the vessel and to solidify said vessel and the mixture therein.

2. A method as claimed in claim 1, wherein the used porcelain slip is a pulverized slip containing preferably 4 to 7% water.

3. Method as claimd in claim 1, wherein the ceramic-forming composition is composed of silicates or alumino silicates of alkaline, alkaline-earth metals, or of magnesium.

4. Method as claimed in claim 1, wherein said ceramic-forming composition is a porcelain.

5. Method as claimed in claim 4, wherein the porcelain is composed of a mixture of feldspar, clay, sand and kaolin.

6. Method as claimed in claim 1, wherein the radioactive waste is ashes from incineration or from a calcinate of solution of fission products or of lead iodide.

7. A method according to claim 5, wherein the porcelain is enriched with alumina.

* * * * *